US006712697B2

(12) United States Patent
Acres

(10) Patent No.: US 6,712,697 B2
(45) **Date of Patent: *Mar. 30, 2004**

(54) METHOD FOR CREDITING A PLAYER OF AN ELECTRONIC GAMING DEVICE

(75) Inventor: John F. Acres, Corvallis, OR (US)

(73) Assignee: Acres Gaming Incorporated, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/123,918

(22) Filed: Apr. 16, 2002

(65) Prior Publication Data

US 2002/0151357 A1 Oct. 17, 2002

Related U.S. Application Data

(63) Continuation of application No. 09/134,598, filed on Aug. 14, 1998, now Pat. No. 6,371,852.
(60) Provisional application No. 60/083,301, filed on Apr. 28, 1998.

(51) Int. Cl.[7] ..... A63F 9/22
(52) U.S. Cl. ..... 463/25; 463/16
(58) Field of Search ..... 463/16, 25, 29, 463/42

(56) References Cited

U.S. PATENT DOCUMENTS

| | | | |
|---|---|---|---|
| 3,598,964 | A | 8/1971 | Dell et al. |
| 4,072,930 | A | 2/1978 | Lucero et al. |
| 4,230,265 | A | 10/1980 | Casaly |
| 4,258,838 | A | 3/1981 | Rockola et al. |
| 4,283,709 | A | 8/1981 | Lucero et al. |
| 4,335,809 | A | 6/1982 | Wain |
| 4,467,424 | A | 8/1984 | Hedges et al. |
| 4,575,622 | A | 3/1986 | Pellegrini |
| 4,624,459 | A | 11/1986 | Kaufman |

(List continued on next page.)

FOREIGN PATENT DOCUMENTS

| | | |
|---|---|---|
| AU | B-27572/84 | 11/1984 |
| AU | B-53370/86 | 10/1989 |
| AU | B-10488/92 | 7/1992 |
| AU | B-20988/92 | 1/1993 |
| AU | B-71194/91 | 5/1994 |
| AU | A-21618/95 | 1/1996 |
| AU | A-48323/97 | 6/1998 |
| GB | 2 211 975 | 7/1989 |
| WO | WO 94/12256 | 6/1994 |
| WO | WO 95/22811 | 8/1995 |
| WO | WO 98/35309 | 8/1998 |
| WO | WO 98/40140 | 9/1998 |

*Primary Examiner*—S. Thomas Hughes
*Assistant Examiner*—Carmen D. White
(74) *Attorney, Agent, or Firm*—Marger, Johnson & McCollom, P.C.

(57) ABSTRACT

A method of providing incentive to play gaming devices connected by a network to a host computer. The casino creates a player account accessible by the host computer. The account can accrue both player-tracking points and account credits. Account credits are applied to a player's account as sign-up incentive, bonus award or other player incentive. When the player inserts his or her card in a card reader at one of the gaming devices, the player has access to the account points and credits. When playing with account credits, the account is debited in the amount of the wager responsive to each game played. The credit meter is simultaneously credited, also in the amount of the wager, thereby effectively providing the player with a free game. In a related implementation, the player can convert account points to account credits thereby redeeming player-tracking points at the machine.

42 Claims, 2 Drawing Sheets

U.S. PATENT DOCUMENTS 4,636,951 A 1/1987 Harlick
4,652,998 A 3/1987 Koza et al.
4,669,596 A 6/1987 Capers et al.
4,669,730 A 6/1987 Small
4,679,143 A 7/1987 Hagiwara
4,760,247 A 7/1988 Keane et al.
4,764,666 A 8/1988 Bergeron
4,775,937 A 10/1988 Bell
4,805,907 A 2/1989 Hagiwara
4,815,741 A 3/1989 Small
4,837,728 A 6/1989 Barrie et al.
4,839,640 A 6/1989 Ozer et al.
4,856,787 A 8/1989 Itkis
4,880,237 A 11/1989 Kishishita
4,882,473 A 11/1989 Bergeron et al.
4,926,996 A 5/1990 Eglise et al.
4,964,638 A 10/1990 Ishida
4,991,848 A 2/1991 Greenwood et al.
5,038,022 A 8/1991 Lucero
5,197,094 A * 3/1993 Tillery et al. ..... 379/91
5,287,269 A * 2/1994 Dorrough et al. ..... 364/408
5,536,016 A 7/1996 Thompson
5,550,359 A 8/1996 Bennett
5,551,692 A 9/1996 Pettitt et al.
5,559,312 A 9/1996 Lucero
5,577,959 A 11/1996 Takemoto et al.
5,580,309 A 12/1996 Piechowiak et al.
5,580,310 A 12/1996 Orus et al.
5,586,936 A 12/1996 Bennett et al.
5,586,937 A 12/1996 Menashe
5,611,730 A 3/1997 Weiss
5,655,961 A 8/1997 Acres et al.
5,674,128 A 10/1997 Holch et al.
5,702,304 A 12/1997 Acres et al.
5,741,183 A 4/1998 Acres et al.
5,743,523 A 4/1998 Kelly et al.
5,752,882 A 5/1998 Acres et al.
5,758,875 A 6/1998 Giacalone, Jr.
5,761,647 A * 6/1998 Boushy ..... 705/10
5,770,533 A 6/1998 Franchi
5,811,772 A 9/1998 Lucero
5,816,917 A 10/1998 Kelmer et al.
5,816,918 A 10/1998 Kelly et al.
5,820,459 A 10/1998 Acres et al.
5,833,540 A 11/1998 Miodunski et al.
5,836,817 A 11/1998 Acres et al.
5,839,956 A 11/1998 Takemoto
5,854,542 A 12/1998 Forbes
5,902,983 A 5/1999 Crevelt et al.
5,919,091 A 7/1999 Bell et al.
6,048,269 A 4/2000 Burns et al.
6,244,958 B1 6/2001 Acres
6,319,125 B1 11/2001 Acres
6,371,852 B1 * 4/2002 Acres ..... 463/25
6,431,983 B2 8/2002 Acres

* cited by examiner

METHOD FOR CREDITING A PLAYER OF AN ELECTRONIC GAMING DEVICE

This application is a continuation of prior application Ser. No. 09/134,598, now U.S. Pat. No. 6,371,852 filed Aug. 14, 1998. The present invention relates to networked electronic gaming machines, such as electronic slot machines, and more particularly to a method for crediting a player of one of the machines. This application also claims the benefit of provisional No. 60/083,301 filed on Apr. 28, 1998.

BACKGROUND OF THE INVENTION

1. Field of the Invention

2. Description of the Related Art

Linking together electronic slot machines on a computer network is known in the art. One example of such a network is disclosed in U.S. Pat. No. 5,572,882 to Acres et al. ("the '882 patent"), which is assigned to the assignee of the present application. The '882 patent is incorporated herein by reference for all purposes. The '882 patent also discloses a number of different bonuses, which pay awards to players at their respective slot machines that are over and above any awards dictated by the pay tables of the machines.

One such bonus award is paid randomly to one of the players via that player's slot machine. Once a slot machine is selected for this type of award, a computer on the network transmits a command to the slot machine that causes it to pay a predetermined amount from the hopper of the machine to the player.

Another type of award is personal to each player and is based on the level of that player's play. As discussed in the '882 patent, a player may be issued a player-tracking card that is insertable into a card reader associated with each slot machine. The network collects data relating to the player's play and stores it in a central computer. Personal awards to the player may be a predetermined amount or a percentage of the player's total play. They are awarded upon the occurrence of a predetermined event, e.g., when the player's cumulative wagers exceeds a predetermined level.

Player tracking points is another award sometimes given to players of networked gaming devices. Each player who uses their card accrues a predetermined number of points for each dollar wagered on the networking gaming machines. Some systems award points for jackpots won on the machines. In any event, the player is eligible to redeem his or her points for complimentary meals, merchandise, or other awards determined by the casino that operates the slot machines. In addition to point accrual based on play, points are often awarded to induce players to sign up for carded play.

In still another effort to induce play on machines, casinos sometimes provide a player with the ability to make complimentary wagers, or to make half price wagers. An example of the foregoing incentives implemented on networked slot machines are disclosed in U.S. application Ser. No. 08/672,217, now U.S. Pat. No. 6,244,958 for A Method for Providing Incentive to Play Gaming Devices Connected by a Network to a Host Computer to Acres ("the '217 application"), which is assigned to the assignee of the present application. The '217 application is incorporated herein by reference for all purposes.

It would be desirable to provide the foregoing incentives, e.g., bonuses, inducements for signing up for carded play, player tracking points, complementary or reduced-price wagering, etc., with a single system. It would be convenient for both the casino and the players for the system to be accessible using the player-tracking card, which is already in use by many of the players. It would be advantageous for such a system to award player credit to machines under conditions determined by the casino whether or not the player was enrolled for carded play. Another advantage relates to providing such awards while permitting the player to continue play at the machines. A further advantage would be awards that can only be taken in further wagers on the machines. In other words, the player cannot cash out the award immediately but must apply it to subsequent wagers made on the machine. Also, the player should be able to cash out any awards won during play. This means the player can have ready access to his or her winnings—and casino overhead is reduced—rather than having to present their card to a casino cashier who gives the winnings to the player.

The foregoing advantages are especially significant in connection with redeeming player tracking points. The system permits conversion of player-tracking points to credits while the players remain at the gaming machines and permits the player to convert back and forth between points and credits that can be wagered. Traditionally, players have had to leave the gaming machines, wait in a line, and present their player-tracking card to redeem accrued points for an award. This system has several disadvantages. First, it requires the player to leave the gaming floor and often wait in line thus depriving the casino of revenues that might have resulted had the player remained on the floor and continued to play. Second, it would be advantageous to the casino to redeem the points for credits to promote additional play rather than for merchandise, meals or the like. If the player could redeem the points for credits on the gaming devices while remaining on the floor, it would also reduce casino overhead devoted to maintaining and delivering awards such as merchandise.

SUMMARY OF THE INVENTION

In one aspect, credit is applied to the player's account. When a game is played, the player account is debited and the gaming device is credited in the amount of the wager.

In another aspect, gaming devices are connected by a network to a host computer. A credit is applied to a player account accessible by the host computer. Access to the account is provide responsive to a command initiated by the player at one of the gaming devices. The account is debited and the gaming device credited responsive to a game played by the player.

In still another aspect, points are accrued in the player account related to the level of player play on the gaming devices. Points in the account are converted to a credit in the player account responsive to a conversion command initiated by the player at the gaming device. The player thereafter wagers credit from the account on the gaming device.

It is accordingly a general object of the present invention to overcome disadvantages associated with prior art methods for awarding and redeeming player-tracking points, bonus awards, and other incentives that do not result from awards dictated by pay tables in the gaming machines.

These and other objects and advantages of the present invention will become more fully apparent when the following detailed description is read in view of the accompanying drawings, wherein:

DETAILED DESCRIPTION OF THE PREFERRED EMBODIMENT

Figure 1:
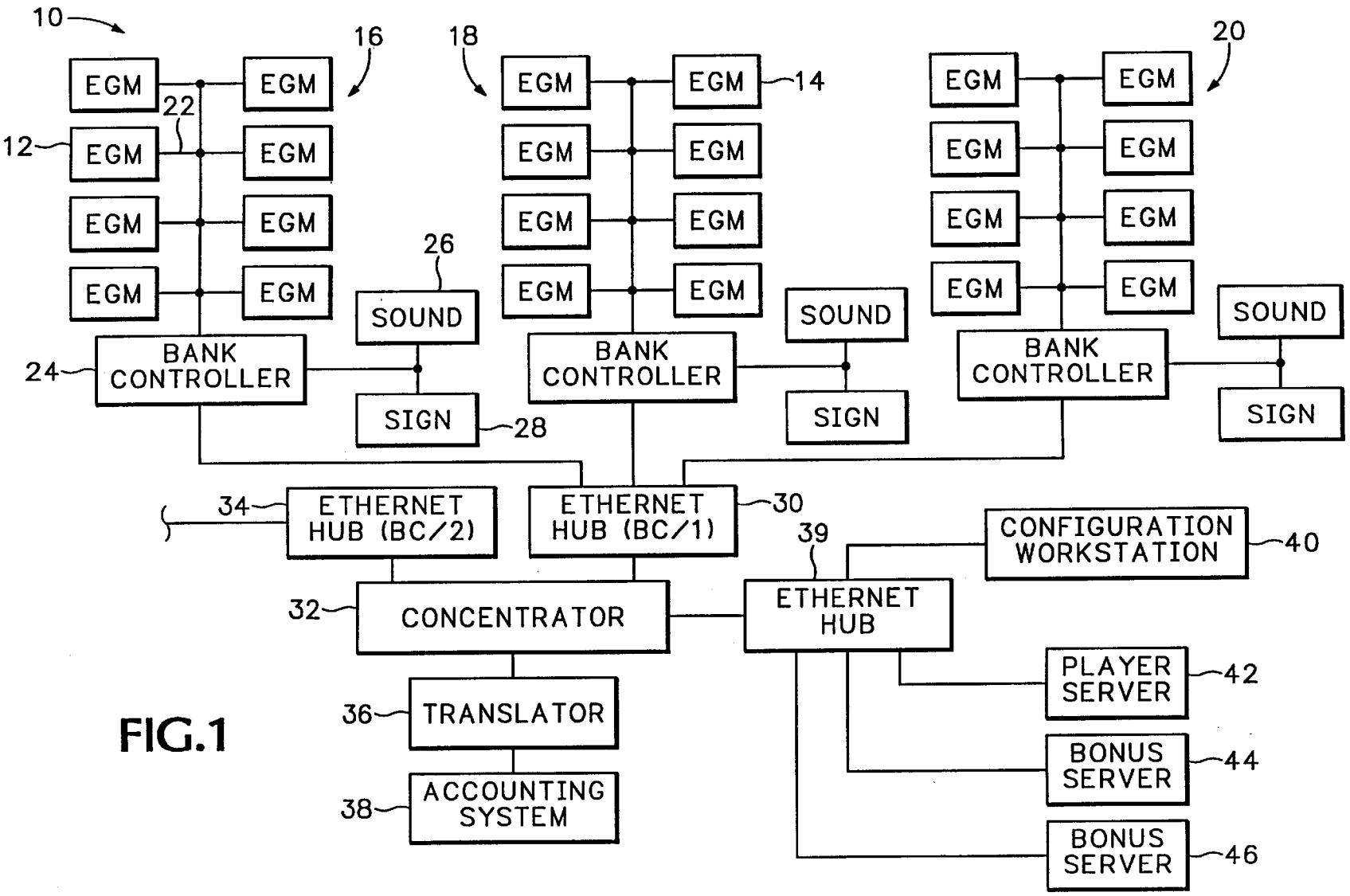
FIG. 1 is a schematic diagram of a plurality of electronic gaming machines interconnected by a computer network to a host computer in accordance with the present invention.

Turning now to FIG. 1, indicated generally at 10 is a schematic diagram illustrating electronic gaming machines (EGMs), like EGMs 12, 14, interconnected by a computer network. Included therein are three banks, indicated generally at 16, 18, 20, of EGMs. Each EGM is connected via a network connection, like connection 22, to a bank controller 24. In the present embodiment of the invention, each bank controller comprises a processor that facilitates data communication between the EGMs in its associated bank and the other components on the network. The bank controller also includes a CD ROM drive for transmitting digitized sound effects, such as music and the like, to a speaker 26 responsive to commands issued over the network to bank controller 24. The bank controller is also connected to an electronic sign 28 that displays information, such as jackpot amounts and the like, visible to players of machines on bank 16. Such displays are generated and changed responsive to commands issued over the network to bank controller 24. Each of the other banks 18, 20 of EGMs include associated bank controllers, speakers, and signs as shown, which operate in substantially the same manner.

Ethernet hub 30 connects each of the bank controllers associated with banks 16, 18, 20 of EGMs to a concentrator 32. Another Ethernet hub 34 connects similar bank controllers (not shown), each associated with an additional bank of EGMs (also not shown), to concentrator 32. The concentrator functions as a data control switch to route data from each of the banks to a translator 36. The translator comprises a compatibility buffer between the concentrator and a proprietary accounting system 38. It functions to place all the data gathered from each of the bank controllers into a format compatible with accounting system 38. The present embodiment of the invention, translator 38 comprises an Intel Pentium 200 MHz Processor operating Microsoft Windows NT 4.0.

Another Ethernet hub 39 is connected to a configuration workstation 40, a player server 42, and to bonus servers 44, 46. Hub 39 facilitates data flow to or from workstation 40 and servers 42, 44, 46.

The configuration workstation 40 comprises a personal computer including a keyboard, Intel Pentium Processor, and Ethernet card. It is the primary user interface with the network.

The player server 42 comprises a microcomputer that is used to control messages that appear on displays associated with each EGM. Player server 42 includes an Intel Pentium Processor and an Ethernet card.

Bonus servers 44, 46 each comprise a microcomputer used to control bonus applications on the network. Each bonus application comprises a set of rules for awarding jackpots in excess of those established by the pay tables on each EGM. For example, some bonus awards may be made randomly, while others may be made to linked groups of EGMs operating in a progressive jackpot mode. Examples of bonuses that can be implemented on the network are disclosed in application Ser. No. 08/843,411, now U.S. Pat. No. 6,319,125, filed Apr. 15, 1997 and assigned to the Assignee of the present application (the '411 application), which is incorporated herein by reference for all purposes. This application also describes in more detail features of the network, like that shown in FIG. 1, that may be used to implement the present invention. The '882 patent also discloses bonuses that can be implemented by bonus servers 44, 46 and a network that could be used to implement the present invention.

As used herein the term jackpot indicates an award made resulting from the pay table on one of the EGMs while the term bonus indicates an award that does not result from the machine's pay table. The '411 application and '882 patent include many examples of bonuses. The term award is intended to encompass any payment given to a player of one of the EGM's and includes both jackpots and bonuses.

Figure 2:
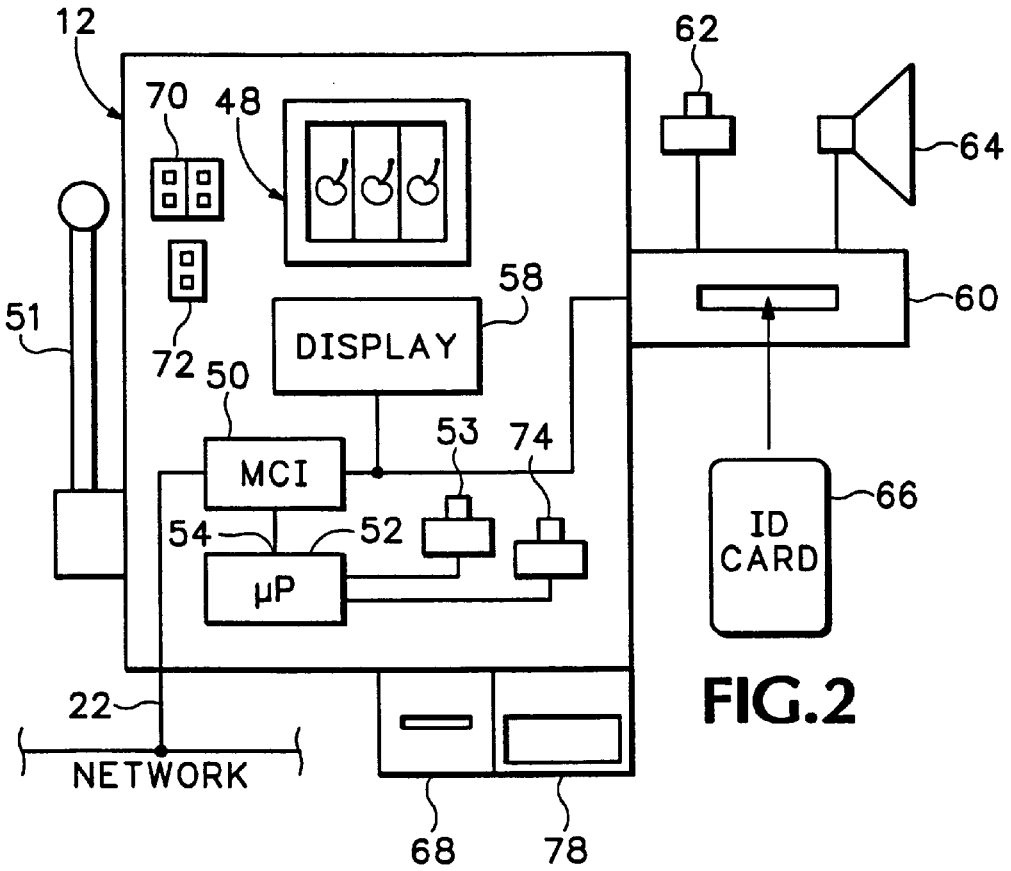
FIG. 2 is a schematic diagram of a slot machine and associated hardware implemented in accordance with the present invention.

FIG. 2 is a highly schematic representation of an electronic slot machine—typical of each of the machines in the network—that incorporates network communications hardware as described hereinafter. This hardware is described in the '882 patent, and is referred to therein as a data communications node. Preferably the network communications hardware is like that disclosed in the '411 application, namely a machine communication interface (MCI) 50. MCI 50 facilitates communication between the network, via connection 22, and microprocessor 52, which controls the operation of EGM 12. This communication occurs via a serial port 54 on the microprocessor to which MCI 50 is connected.

Included in EGM 12 are three reels, indicated generally at 48. Each reel includes a plurality of different symbols thereon. The reels spin in response to a pull on handle 51 or actuation of a spin button 53 after a wager is made.

MCI 50 includes a random access memory (RAM), which can be used as later described herein. The MCI also facilitates communication between the network and a vacuum florescent display (VFD) 58, a card reader 60, a player-actuated push button 62, and a speaker 64.

Before describing play according to the invention, description will first be made of typical play on a slot machine, like EGM 12. A player plays EGM 12 by placing a wager and then pulling handle 51 or depressing spin button 53. The wager may be placed by inserting a bill into a bill acceptor 68. A typical slot machine, like EGM 12, includes a coin acceptor (not shown) that may also be used by the player to make a wager. A credit meter 70 is a numeric display that indicates the total number of credits available for the player to wager. The credits are in the base denomination of the machine. For example, in a nickel slot machine, when a five dollar bill is inserted into bill acceptor 68, a credit of 100 appears on credit meter 70. To place a wager, the player depresses a coin-in button (not shown), which transfers a credit from the credit meter 70 to a coin-in meter 72. Each time the button is depressed a single credit transfers to the coin-in meter up to a maximum bet that can be placed on a single play of the machine. In addition, a maximum-bet button (also not shown) may be provided to immediately transfer the maximum number of credits that can be wagered on a single play from the credit meter 70 to the coin-in meter 72.

When coin-in meter 72 reflects the number of credits that the player intends to wager, the player depresses spin button 53 thereby initiating a game.

The player may choose to have any jackpot won applied to credit meter 70. When the player wishes to cash out, the player depresses a cash-out button 74, which causes the credits on meter 70 to be paid in coins to the player at a hopper 78, which is part of machine 12. The machine consequently pays to the player, via hopper 78, the number of coins—in the base denomination of the machine—that appear on credit meter 70.

Card reader 60 reads a player-tracking card 66 that is issued by the casino to individual players who choose to have such a card. Card reader 60 and player-tracking card 66 are known in the art, as are player-tracking systems, examples being disclosed in the '882 patent and '411 application. Briefly summarizing such a system, a player registers with the casino prior to commencing gaming. The casino issues a unique player-tracking card to the player and opens a corresponding player account that is stored on accounting system 38 (in FIG. 1). Accounting system 38 is referred to herein as a host computer. It should be appreciated, however, that the host computer can be distributed on the network and could include multiple processors or memories. The account includes the player's name and mailing address and perhaps other information of interest to the casino in connection with marketing efforts. Prior to playing one of the EGMs in FIG. 1, the player inserts card 66 into reader 60 thus permitting accounting system 38 to track player activity, such as amounts wagered and won and rate of play.

To induce the player to use the card, the casino awards each player points proportional to the money wagered by the player. Players consequently accrue points at a rate related to the amount wagered. The points are displayed on display 58. In prior art player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

Before describing the manner in which the present invention is implemented on the network of slot machines depicted in FIG. 1, consideration will first be given to terminology used in the description.

First, a player-tracking account is one that is established by the casino, typically for an identified player—although the invention could be implemented with an anonymous account. The player-tracking account is referred to herein as a player account. When the player inserts his or her card into card reader 60 of EGM 12, information related to that player's account is fetched from the host computer, transmitted on the network, and stored in the RAM included in MCI 50 of EGM 12. Such information includes player-tracking points, which are referred to herein as account points. In accordance with the present invention, the player's account may also include credits that may be transferred by the player from the player's account to credit meter 70 on the machine and thereafter wagered by the player. These credits in the player's account are referred to herein as account credits and are awarded and redeemed as described hereinafter. Credits appearing on credit meter 70 of EGM 12 are referred to herein as meter credits.

One way in which account credits may be applied to a player's account is as an incentive to open the account. In other words, when the account is opened by the casino, an account credit, e.g., $5, is applied to the account. The following Table 1, which is described in more detail below, sets forth the sequence followed by the player to redeem the account credits for play on EGM 12.

TABLE 1

| |
|---|
| 1. Player account information, including account credits and points, is stored in MCI 50 RAM responsive to insertion of card 66 into reader 60. |
| 2. Player places wager by inserting bill into bill acceptor 68 or coin into the coin acceptor (not shown). |
| 3. Player plays game by pushing spin button 53. |
| 4. Responsive to play, the account credits are automatically debited in the amount of the wager and applied to credit meter 70. |
| 5. Steps 3 and 4 are repeated so long as the player wishes to play. |
| 6. When the player is finished playing, he or she pushes cash-out button 74 and withdraws card 66 from reader 60. |

When the player inserts card 66 into reader 60, the account information is fetched from the host computer in step 1 above. The amount of account credit available appears on display 58 in the denomination of the machine being played. In the example above, with an initial account credit in the amount of $5, when the card is inserted into a nickel slot machine display 58 shows: Account Credit=100. If the player was using a dollar slot machine, display 58 would show: Account Credit=5.

When a player account is accessed responsive to insertion of the player's card, the host computer prevents the account from being accessed from another slot machine. This blocks the use of a duplicate card to load the account into a second machine after the account information has already been fetched from the host computer and loaded into a first machine. This can be accomplished in a manner similar to that used to prevent a document from being loaded into a word processor operating on two different computers on a network. In other words, after the document is loaded, it is locked out from being loaded into a second word processor on the network.

In steps 2 and 3, the player places a wager, for example, in the amount of $0.15 via the coin acceptor and presses spin button 53 to play the game. If the player deposits coins or bills, via bill acceptor 68, in excess of the amount wagered, the balance appears on credit meter 70. But in the present example, assume that the wager is made via the coin acceptor and that there is a zero balance on the credit meter after the wager is applied to coin-in meter 72 and before the player pushes spin button 53.

When the player presses the spin button, the reels begin to spin. Also in response to pressing the spin button, coin-in meter 53 goes to zero, the account credits are debited by 3 (the amount of the wager in the number of coins applied to coin-in meter 72), and credit meter 70 is credited by 3—effectively restoring the player's initial wager. Display 58 now shows: Account Credit=97, credit meter 70 now shows a balance of 3, and the player has had a free game.

It should be appreciated that the credit applied to the meter after the reels spin, could be in amounts other than a one-to-one ratio. That is, instead of matching each credit bet with a credit applied to the credit meter, the casino could choose to award, e.g., a half credit for each credit bet, or could make the award greater, e.g., two credits applied to the credit meter for each credit bet. The present embodiment, however, is described with a matching credit applied to the credit meter for each credit bet.

The player may, if he or she so chooses, redeem the meter credits by depressing cash-out button 74, or may continue to play. Assume that the player elects to wager 2 credits on the next game. The player depresses the coin-in button (not shown) to transfer 2 credits from credit meter 70 to coin-in meter 72. Credit meter 70 then shows a balance of 1 and coin-in meter displays 2. When spin button 53 is depressed to play the game, 2 more credits are deducted from the account credits and added to credit meter 70. After the game, display 58 shows: Account Credit=95. And credit meter 70 shows a balance of 3, 1 credit remaining from before the game and 2 added from the account credits responsive to the play.

Assume this game resulted in a 10 coin win based on the pay table in EGM 12. This win is applied to credit meter 10, which now shows a balance of 13. The player may again decide to cash out and thus retrieve the 10 coin win and the initial 3 coin investment. All 5 credits wagered came from the account credits, which now has a 95 credit balance.

With this system, the player must wager each account credit he or she wishes to cash out. In other words, the player can not cash out the account credits without wagering them. All awards, whether from jackpots or bonuses, are applied to credit meter 70. When the player finishes wagering, he or she cashes out and removes his or her card. When the player wishes to resume wagering, on EGM 12 or on any other of the EGM's connected to the network of FIG. 1, the card is again inserted into the card reader, like reader 66, associated with the EGM played by the player. The display shows: Account Credit=95. And the player must again use their own money, recovered from cashing out at the last machine, to initiate the wagers.

Account credits can be applied by the casino to a players account as a player-tracking sign-up award, as in the example above. In addition, the casino might credit the account for a special date such as a birthday, an anniversary, etc., and send mail to the player notifying him or her of this credit.

Another promotion is described in the '411 application and is referred to therein as Welcome Back. In that promotion, a player who earns a predetermined minimum number of account points has their account credited for half-priced wagering as described in the '411 and '217 applications. This encourages the player to return to the casino at a later time. This award could be made in account credits that are redeemed as described in the present application.

Similarly, any of the bonus awards described in the '882 patent or in the '411 application could be made in account credits rather than being applied directly to the credit meter. For example, some random awards are funded by placing a preselected percentage of wagers made into a bonus pool. The wagers may be made either on a preselected group of machines or by a single identified, player playing on different machines. The group is preselected by the casino at workstation 40 with the host computer accounting for the bonus pool for that group, as well as other groups of machines. Such a preselected group is referred to as a link. After a minimum amount is accrued in the bonus pool, the pool, or a portion thereof, is awarded at random to an eligible player. Such awards, rather than being paid to the credit meter, could be in the form of account credits that must be redeemed as described above.

Another bonus award that could be made in account credits occurs when a big win is won. For example, assume that one of the slot machines pays a large amount, defined by the casino as being over a predetermined amount. This big win could be a result of a jackpot, dictated by the machine's pay table, or as a result of one of the random or other bonuses that does not result from the machines pay table.

When a big win occurs, all the same machines on the link (or all the machines on the network) can be paid a bonus, either in the form of a credit to the credit meter or as account credits or points. Such a bonus can be programmed at the host computer to occur responsive to the big win. The casino can impose eligibility criteria for awarding this bonus, such as a predetermined rate or level of play. In addition, the casino can also condition that such bonuses be paid only to carded players as a further incentive to enroll players in the player-tracking system. On the other hand, awards could still be made to uncarded players but carded players could give larger awards, also as an incentive to register for and use a player-tracking card. The big-win award is made to all of the players on the link by crediting the RAM in each MCI 50 on the link with a predetermined amount of account credit. Uncarded players therefore receive the same credit as a carded player. The uncarded player must, however, use all of the account credits on the machine to which the award is made. Thus, applying credit to a player's account may be done manually by the casino at a keyboard when, e.g., the player signs up for carded play. This credit is applied to the player's account on the host computer. As described above, the credit may also be applied to either a carded or uncarded player by awarding account credits over the network directly to the RAM in MCI 50 in the player's EGM.

The big-win award could be in a predetermined amount of money (in account credits) or as a multiple of the player's last wager. Alternatively, the award could be in account credits, e.g., 5 credits. A player on a $1 machine would get a $5 account credit and a player on a quarter machine would receive a $1.25 account credit.

Finally, big-win awards have an expiration time. If button 62 is not pressed within a predetermined number of seconds after the award is made, it expires and will not be granted.

This prevents a nonplayer from collecting an award at a machine that a player has just walked away from. Display 58 coupled with audible signals from speaker 64 clearly indicate to the player the need to press button 62 to collect the prize.

Another important feature of the present invention permits a player to convert account points to account credits at the slot machine and without involvement of casino personnel. The following Table 2, which is described in more detail below, sets forth the sequence followed by the player to convert account points to account credit at EGM 12.

TABLE 2

1. Player account information, including account credits and points, is stored in MCI 50 RAM responsive to insertion of card 66 into reader 60.
2. Display 58 displays account points.
3. Player pushes button 62 to convert all account points to account credits, which now appear on display.
4. Player places wager by inserting bill into bill acceptor 68 or coin into the coin acceptor (not shown).
5. Player plays game by pushing spin button 53.
6. Responsive to play, the account credits are automatically debited in the amount of the wager and applied to credit meter 70.
7. Steps 5 and 6 are repeated so long as the player wishes to play.
8. When the player is finished playing, he or she pushes cash-out button 74 and withdraws card 66 from reader 60.

When the player inserts card 66 into reader 60, the account information is fetched from the host computer in step 1 above. In step 2, the amount of account points accrued appears on display 58. In the present example, assume the casino awards one point for every $.01 wagered. A player having wagered $50 has consequently accrued 5,000 account points, which is the number appearing on display 58.

In step 3, the player pushes button 62 and thereby converts the account points to account credits, using the value assigned by the casino for each account point. Assuming the EGM is a dollar machine, display 58 consequently shows: Account Credit=50.

Steps 4 through 8 occur in the same manner as described for steps 2 through 6 in the example associated with Table 1. In other words, account credits are debited after each play in the amount of the wager with that amount being also credited on the credit meter. All awards, whether from jackpots or bonuses, are applied to the credit meter.

In step 8, when the player is finished playing, he or she may cash out any amount on credit meter 70 by pushing cash-out button 74 and withdraw card 66 from reader 60. When the player next inserts the card into one of the card readers on the network, the balance in points appears in display 58.

Any awarded account credits, e.g., as a result of a bonus or big-win award, cause the display to show those account credits and to indicate decreasing amounts as play proceeds. If the player has already converted account points to account credits—as described above—when the award is made, the awarded account credits (as opposed to the converted account credits) are played off first to protect the points. If, however, a player stops play before all the awarded account credits are used, the account has a balance in both account points and account credits, with the account-credit balance appearing on the display of the machine when the player next logs in.

Also, account credits that have been converted from points are always stored as points when the player logs out. For example, assume the player has 5,000 points and converts them to 50 account credits. The player then plays down to 42 account credits and when he or she logs out, the account balance shows 4,200 points. On the other hand, if the player converts the 5,000 points to 50 account credits and then receives a big-win prize of 20 account credits, the player's balance is 70 account credits: 50 converted from points, and 20 awarded. If the player logs out after only nine of the account credits are used, the system stores 5,000 account points and 11 account credits in the player's account. When the player next logs on to a machine, the number of account points—5,000—are displayed, and the display then changes to Account credit=11. These credits are used as play proceeds.

In another example, assume the player converts 5,000 points into 50 account credits and plays 8 of the account credits. If an award of 20 account credits is then made, the display indicates 62 account credits, and play continues. If the player then plays down an additional five credits, then logs out, the account has 4,200 points and 15 account credits, the account credits being displayed the next time the player logs in.

The activity described in the preceding examples takes place at the MCI 50 and associated RAM after the player's account information is retrieved from the host computer. When the player logs out, any remaining points or account credits are again stored in the account on the host computer.

Account credits awarded to uncarded players, for example, big-win, must be used at the machine or are forfeited.

With this system, player points are redeemed for additional gaming rather than for merchandise, meals, or the like. The casino would prefer to be providing gaming to players rather than maintaining and dispensing an inventory of noncash items. In addition, the present system prevents a break in gaming. Rather than the player waiting in line to redeem points, the player is on the floor playing the games, which again enables the casino to continue to provide gaming to the player. The player also has the flexibility of converting back and forth between account credits and account points, as he or she chooses. Because the points are converted to account credits rather than to credits on the gaming meter, the player can redeem the credits one wager at a time, i.e., they can not be cashed out at once.

In all embodiments disclosed herein, any jackpots or bonuses won are applied to the credit meter, which the player can cash out or wager as he or she sees fit. In addition, account credits can be applied either at the host computer or locally over the network. The account credits may be applied either manually, responsive to input by casino personnel at a keyboard, or in response to bonus rules that are programmed on the host computer. Finally, it is a significant advantage that this system is implemented with the player tracking card, because many players already have and use one.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of providing incentive to play gaming devices connected by a network to a host computer comprising:

applying an incentive credit to a memory associated with one of the gaming devices;

providing access to the memory responsive to a command initiated by a player at said one gaming device;

debiting the credit in the memory responsive to a game played at said one gaming device;

crediting said one gaming device responsive to debiting the credit in the memory; and preventing the applied incentive credit from being cashed out.

2. The method of claim 1 wherein said method further comprises making a wager on the gaming device and wherein the amount debited from the memory and credited to the gaming device is equal to the wager.

3. The method of claim 1 wherein crediting the gaming device comprises applying credit to a credit meter associated with the gaming device.

4. The method of claim 1 wherein said method further comprises paying an award to the player by applying credit to a credit meter associated with the gaming device.

5. The method of claim 4 wherein said award comprises a jackpot.

6. The method of claim 4 wherein said award comprises a bonus.

7. The method of claim 1 wherein applying an incentive credit to the memory comprises transmitting data over the network.

8. The method of claim 1 wherein crediting the gaming device comprises transferring credit from the memory to a credit meter associated with the gaming device responsive to a game played at the gaming device.

9. The method of claim 1 wherein applying an incentive credit to the memory comprises awarding a bonus to the memory.

10. The method of claim 9 wherein awarding a bonus comprises awarding a bonus independently of a jackpot awarded pursuant to a pay table in the gaming device.

11. The method of claim 1 wherein said method further includes displaying the current amount of credit in the memory.

12. The method of claim 1 wherein applying an incentive credit to the memory occurs before the command initiated by the player.

13. The method of claim 1 wherein crediting said one gaming device responsive to debiting the credit in the memory comprises crediting said one gaming device with the amount debited from the memory.

14. The method of claim 1 wherein said player is uncarded.

15. A method of providing incentive to play gaming devices connected by a network to a host computer comprising:

applying an incentive credit to a memory associated with one of the gaming devices;

accessing information in the memory responsive to a command initiated by a player at one of the gaming devices;

detecting a wager made by the player;

detecting a game played on said one gaming device;

debiting the credit in the memory in the amount of the wager responsive to the game played;

crediting the gaming device in the amount of the wager; and preventing the applied incentive credit from being cashed out.

16. The method of claim 15 wherein crediting the gaming device comprises applying credit to a credit meter associated with the gaming device.

17. The method of claim 15 wherein said method further comprises paying to the player an award that results from gaming-device play utilizing credit from the memory.

18. The method of claim 17 wherein paying to the player an award that results from gaming-device play utilizing credit from the memory comprises applying credit to a credit meter associated with the gaming device.

19. The method of claim 15 wherein said player is uncarded.

20. The method of claim 15 wherein crediting the gaming device comprises applying credit to a credit meter associated with the gaming device.

21. The method of claim 15 wherein said method further comprises paying an award to the player by applying credit to a credit meter associated with the gaming device.

22. The method of claim 21 wherein said award comprises a jackpot.

23. The method of claim 21 wherein said award comprises a bonus.

24. The method of claim 15 wherein applying an incentive credit to the player account comprises transmitting data over the network.

25. The method of claim 15 wherein crediting the gaming device comprises transferring credit from the player account to a credit meter associated with the gaming device responsive to a game played at the gaming device.

26. The method of claim 15 wherein applying an incentive credit to the player account comprises awarding a bonus to the memory.

27. The method of claim 26 wherein awarding a bonus comprises awarding a bonus independently of a jackpot awarded pursuant to a pay table in the gaming device.

28. The method of claim 15 wherein said method further includes displaying the current amount of credit in the memory.

29. A method of providing incentive to play gaming devices connected by a network to a host computer comprising:

applying an incentive credit to a memory associated with one of the gaming devices;

accessing information in the memory responsive to a command initiated by a player card at said one gaming device;

applying credit from the memory to said one gaming device responsive to a game played on said one gaming device; and preventing the applied incentive credit from being cashed out.

30. The method of claim 29 wherein said method further comprises:

associating said one gaming device with a card reader;

issuing a card to the player; and associating the card with the player account.

31. The method of claim 30 wherein the command initiated by the player comprises receiving the card into one of the card readers.

32. The method of claim 29 wherein said method further comprises preventing applying incentive credit from the memory to the gaming device until after said game is played.

33. The method of claim 32 wherein said method further comprises preventing more than one transfer of incentive credit from the memory to the gaming device between each game played.

34. The method of claim 29 wherein said method further comprises accruing points in a player account related to the level of player play on the gaming devices and wherein said method further comprises converting points in the player account to a credit in the player account responsive to a conversion command initiated by the player at said one gaming device.

35. The method of claim 29 wherein said player is uncarded.

36. A method of providing incentive to play a gaming device comprising:

applying incentive credit to a memory associated with the gaming device;

detecting a game played on the device;

debiting the credit in the memory responsive to the game played;

crediting the gaming device responsive to debiting the credit in the memory; and preventing the applied incentive credit from being cashed out.

37. The method of claim 36 wherein said method further comprises detecting a wager made by a player of the gaming device and wherein the step of debiting the credit in the memory responsive to the game played comprises debiting the credit in the memory in the amount of the wager.

38. The method of claim 36 wherein crediting the gaming device responsive to debiting the credit in the memory comprises crediting the gaming device in the amount of the wager.

39. The method of claim 36 wherein crediting the gaming device comprises applying a credit to a credit meter associated with the gaming device.

40. The method of claim 36 wherein said gaming device is one of a plurality of gaming devices connected by a network to a host computer and wherein applying incentive credit to the memory comprises transmitting data over the network.

41. The method of claim 40 wherein crediting the gaming device responsive to debiting the credit in the memory comprises crediting a credit meter associated with the gaming device in the amount of the wager.

42. The method of claim 36 wherein said player is uncarded.

* * * * *

UNITED STATES PATENT AND TRADEMARK OFFICE

CERTIFICATE OF CORRECTION

PATENT NO. : 6,712,697 B2
DATED : March 30, 2004
INVENTOR(S) : Acres

It is certified that error appears in the above-identified patent and that said Letters Patent is hereby corrected as shown below:

Column 1,
Line 12, "BACKGROUND OF THE INVENTION" should be moved to line 3.
Line 14, "1. Field of the Invention" should be moved to line 4.

Column 8,
Line 33, "granted. ¶This prevents" should read -- granted. This prevents --.

Signed and Sealed this

Fourth Day of January, 2005

JON W. DUDAS
*Director of the United States Patent and Trademark Office*